United States Patent [19]

Yaeger et al.

[11] 4,321,797

[45] Mar. 30, 1982

[54] QUICK CONNECTOR AND SHUT-OFF VALVE ASSEMBLY FOR HEAT RECOVERY SYSTEM

[75] Inventors: Ronald J. Yaeger; Gerald W. Keller, both of Dallas, Tex.

[73] Assignee: Air & Refrigeration Corp., Dallas, Tex.

[21] Appl. No.: 139,998

[22] Filed: Apr. 14, 1980

Related U.S. Application Data

[62] Division of Ser. No. 949,082, Oct. 6, 1978.

[51] Int. Cl.[3] ..... F25B 7/00; F25B 27/02

[52] U.S. Cl. ..... 62/79; 62/238.6

[58] Field of Search ..... 62/238 E, 160, 324

[56] References Cited

U.S. PATENT DOCUMENTS

| | | | |
|---|---|---|---|
| 1,874,803 | 8/1932 | Reed | 62/238 E |
| 3,719,058 | 3/1973 | Waygood | 62/200 |
| 3,916,638 | 11/1975 | Schmidt | 62/160 |
| 3,926,008 | 12/1975 | Webber | 62/200 |
| 4,103,510 | 8/1978 | Hall | 62/299 |

*Primary Examiner*—Lloyd L. King

*Attorney, Agent, or Firm*—Kenneth R. Glaser

[57] ABSTRACT

A waste heat recovery system for use with refrigeration means and a hot water reservoir is disclosed. The system is intended for use with refrigeration means of the type including a compressor and a condenser through which a compressible refrigerant is circulated. The system includes a heat exchanger having a refrigerant passage and a water passage mutually coupled in heat exchange relation. A heat exchange circulation conduit connects the water passage of the heat exchanger in fluid communication with the hot water reservoir to permit water to be circulated from the reservoir to the heat exchanger and return. A precharged refrigerant conduit connects the outlet port of the compressor in fluid communication with the condenser and includes a pair of bypass conduit sections terminated by quick connect/disconnect coupling members for connection to the refrigerant passage of the heat exchanger. A shut-off valve is connected in series fluid circuit relation in the refrigerant conduit intermediate the upstream and downstream bypass sections. The refrigerant passage of the heat exchanger is also precharged and includes inlet and outlet conduit sections having complementary quick connect/disconnect coupling members for engagement with the corresponding quick connect coupling members of the bypass conduit sections.

1 Claim, 2 Drawing Figures

QUICK CONNECTOR AND SHUT-OFF VALVE ASSEMBLY FOR HEAT RECOVERY SYSTEM

This is a division of application Ser. No. 949,082, filed 10/6/78.

BACKGROUND OF THE INVENTION

1. Field of the Invention

The present invention relates to heat recovery systems, and in particular relates to such systems which recover the waste heat of air conditioning and refrigeration systems for purposes of heating water.

2. Description of the Prior Art

Because of the rapidly rising costs of energy, the incentives to conserve energy are increasing, both for industrial users and domestic users. Consequently there is considerable interest in not only eliminating energy waste by making equipment more efficient, but also by recovering energy such as waste heat which, according to conventional practice, is usually injected into the atmosphere without recovery.

It is well known in the art to use some of the heat from the condensing process of a refrigeration system to produce hot water in a storage tank. Heat is reclaimed by employing a heat exchanger in the hot gas line between the compressor and the condenser of the air conditioning system. Water from the bottom of the hot water heater is circulated through the heat exchanger by means of a small circulating pump. This basic arrangement has been used with success and is gaining widespread acceptance; but there is continuing interest in improving this basic system to make it more efficient and responsive.

The potential for energy conservation by the recovery of waste heat in the home and in industrial applications is substantial because of the amount of energy required to operate air conditioning equipment and hot water heating equipment, both of which are significant users of energy. For example, an air conditioning system with a water cooled condenser, while producing a ton of refrigeration or 12,000 BTUH of cooling capacity, also produces approximately 15,000 BTUH of heat which is rejected to the atmosphere. An air conditioning system with an air cooled condenser rejects about 16,000 to 17,000 BTUH for each ton or 12,000 BTUH of cooling capacity. Of this 15,000 to 17,000 BTUH of heat for each ton of capacity, 3,000 to 5,000 BTUH is relatively easy to recover at a very nominal expense. Generally, the refrigeration system is operated totally separate from the hot water system with the result that the heat removed from the condensing process is wasted, while the water in the hot water system is heated by means of an auxiliary energy source such as gas, electricity, or oil. The cost of such fuel and energy can be great particularly in situations where a large amount of hot water is required.

One problem associated with the installation of a hot gas-to-water heat exchanger for recovery of waste heat in an existing refrigeration or air conditioning system is that the hot gas refrigerant line from the compressor to the condenser must be cut to connect the refrigerant passage of the heat exchanger. During this procedure, the refrigerant charge is lost to the atmosphere and requires that the entire refrigerant system be purged, evacuated and recharged with refrigerant. An additional problem is that of replacing the heat exchanger from time to time because of malfunction or maintenance, or for substituting a larger or smaller heat exchanger as hot water production requirements change. Because of the very large amount of waste heat which can be recovered from the refrigeration process, it may be desirable to substitute a more efficient or a larger capacity heat exchanger in place of a relatively smaller one to satisfy increased hot water production requirements. This substitution procedure cannot be carried out in conventional heat recovery systems without severing the refrigerant line leading to the heat exchanger which requires that the system be purged, evacuated and recharged with refrigerant which is both time consuming and expensive. Additionally, it may be desirable to temporarily thermally decouple the heat exchanger from the refrigeration system when the hot water system is undergoing maintenance or has been withdrawn from service, and later re-establish the heat transfer relation when hot water service has been restored. Such an arrangement which would permit thermal decoupling without requiring mechanical detachment of the heat exchanger would provide a substantial saving of time and labor.

SUMMARY OF THE INVENTION

It is, therefore, a principal object of the present invention to provide a waste heat recovery system in which the heat exchanger can be connected or disconnected without losing the refrigerant charge and without introducing contaminants into the system and which permits thermal decoupling of the heat exchanger without mechanical detachment if desired.

The foregoing objects and advantages are carried out according to the present invention in a waste heat recovery system for use with a refrigeration system of air conditioning system having a compressor thermally coupled to a hot water reservoir such as a conventional hot water heater. The system includes a heat exchanger having a refrigerant passage and a water passage mutually coupled in heat exchange relation. A heat exchange circulation conduit connects the water passage of the heat exchanger in fluid communication with the hot water reservoir to permit water to be circulated from the reservoir to the heat exchanger and return. According to the invention, the refrigerant passage of the heat exchanger is precharged with refrigerant and is provided with inlet and outlet conduit sections which are terminated by quick connect/disconnect coupling members which automatically seal the refrigerant passage for retaining the refrigerant charge when the heat exchanger is disconnected and for permitting circulation of refrigerant through the inlet and outlet sections when they are engaged by a complementary quick connect/disconnect coupling member.

The output of the compressor is connected to the condenser through a precharged refrigerant conduit having first and second bypass conduit sections coupled in fluid communication with the refrigeration conduit, and each bypass section being terminated by a quick connect/diconnect coupling member which is automatically sealed for retaining a refrigerant charge in the refrigeration conduit when not engaged. A shut-off valve is connected in series fluid circuit relation in the refrigeration conduit intermediate the union of each bypass conduit section with the refrigeration conduit. According to this arrangement, the precharged refrigerant passage of the heat exchanger is connected in parallel fluid circuit relation with the shut-off valve. The upstream bypass conduit is connected in fluid communication when the inlet conduit section of the heat exchanger refrigerant passage is engaged with the corresponding quick connect/disconnect coupling members. The bypass conduit disposed downstream of the shut-off valve is connected in fluid communication with the outlet conduit section of the heat exchanger refrigerant passage when the corresponding quick connect-/disconnect coupling members are engaged.

According to the foregoing arrangement, the heat exchanger can be connected or disconnected from the refrigerant conduit without the loss of refrigerant and without introducing contaminants into the refrigeration conduit. Furthermore, the flow of refrigerant can be selectively diverted through the heat exchanger when the refrigerant passage is connected to the refrigerant conduit and when the shut-off valve is closed. This arrangement permits the heat exchanger to be completely decoupled either thermally and/or mechanically from the refrigeration system when desired. This arrangement also facilitates installation of the heat recovery system in that the air conditioning or refrigeration system can be connected up, balanced and tested prior to connecting the heat exchange equipment which can be connected into the system at a later time as desired without requiring the refrigeration system to be purged and recharged. This arrangement also permits easy removal of the heat exchanger for repair or replacement without interfering with the refrigerant system. Since the fluid impedance of the heat exchanger water passage is relatively large, the heat exchanger can be thermally decoupled without mechanical detachment merely by opening the shut-off valve, which provides a low resistance bypass for the refrigerant flow.

The foregoing and other objects, advantages and features of the invention will hereinafter appear, and for purposes of illustration, but not of limitation, an exemplary embodiment of the subject invention is shown in the appended drawing.

DETAILED DESCRIPTION OF A PREFERRED EMBODIMENT

Figure 1:
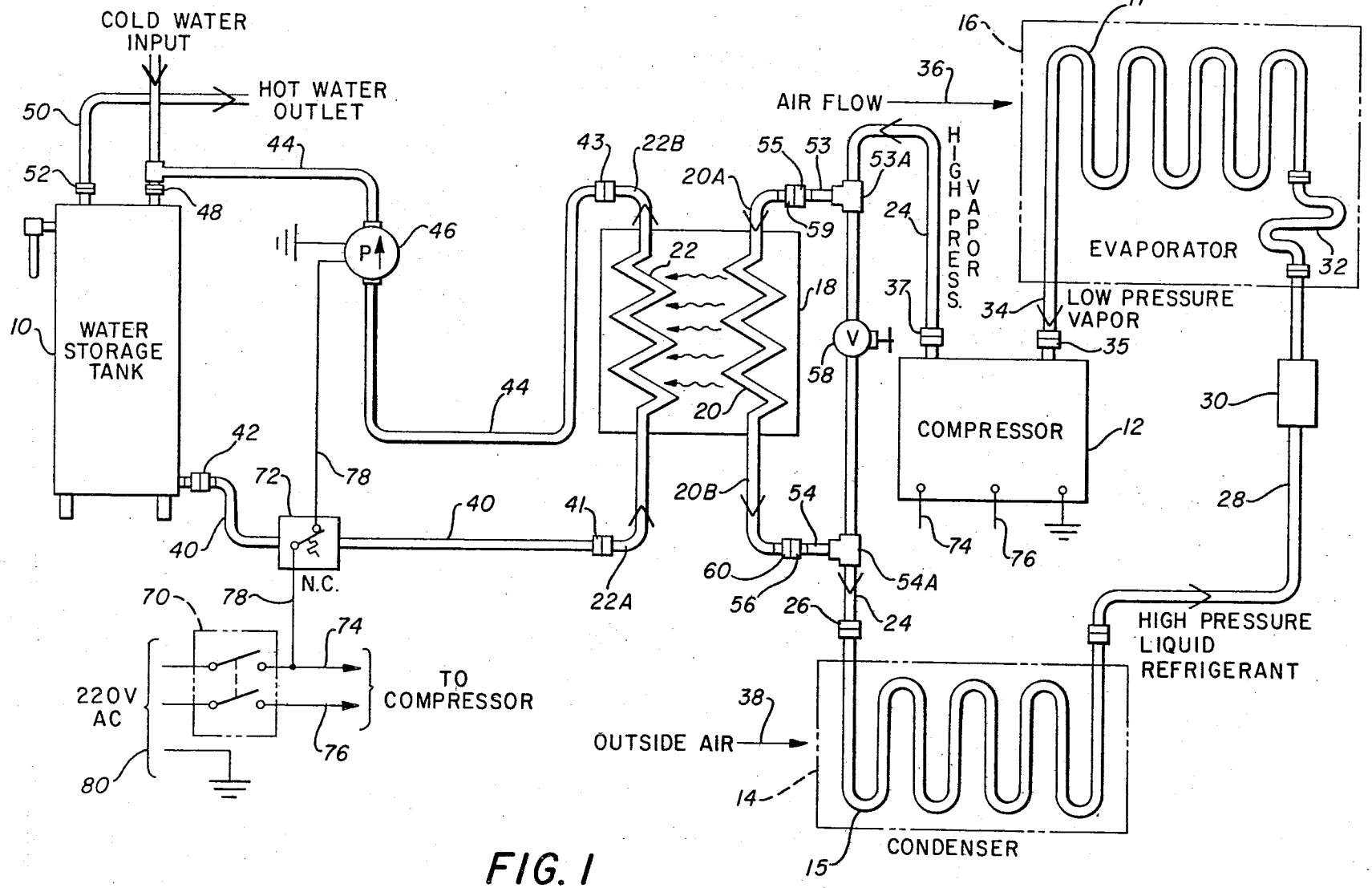
FIG. 1 is a schematic diagram of the waste heat recovery system constructed according to the teachings of the present invention; and, FIG. 2 is a perspective view of the heat exchanger and shut-off valve assembly of the invention.

In the description which follows, like parts are marked throughout the specification and drawing with the same reference numerals, respectively.

Referring now to FIG. 1 of the drawing, the waste heat transfer system of the invention includes a hot water reservoir 10 which may be of any conventional size, for example a forty gallon hot water heater tank as commonly found in a residence, or a substantially larger hot water reservoir as may commonly be found in a commercial establishment, and an air conditioning or refrigeration system which includes a compressor 12, a condenser 14 and an evaporator 16. The compressor 12, condenser 14 and evaporator 16 are suitably interconnected to provide air conditioning for a residence or refrigeration for a commercial establishment. Air to be conditioned within the refrigeration areas is brought into heat exchange relation with the evaporator 16 by means of suitable circulation equipment (not shown) into the area being conditioned. An outside fan (not shown) brings outdoor air into heat exchange relation with the condenser 14.

The hot water tank 10 and the refrigeration system are thermally coupled by means of a heat exchanger 18 which includes a refrigerant passage 20 and a water passage 22 which are mutually coupled in heat exchange relation. A suitable refrigerant is circulated through the refrigerant passage 20 and is discharged into the condenser 14 through a condenser inlet port 26. The condenser 14 is connected in series fluid circuit relation with the evaporator 16 by means of a high pressure liquid refrigerant line 28. Prior to entering the evaporator 16, the refrigerant passes through a combination filter and dryer unit 30 which is connected in series fluid circuit communication with a capillary tube or an expansion valve 32 according to conventional practice. Refrigerant is circulated through the evaporator and is discharged through a low pressure vapor suction line 34 where it enters the inlet port 35 of the compressor 12.

In operation, liquid refrigerant flows from the condenser 14 up through the high pressure liquid refrigerant line 28 to the combination filter/dryer 30. From the filter/dryer, the refrigerant flows through the capillary tube 32 into the evaporator 16. The pressure of the liquid refrigerant as it enters the capillary tube at the filter end is at a high pressure, while the pressure in the evaporator 16 is at a low pressure. The design of the capillary tube 32 is such that it maintains a pressure difference while the compressor 12 is operating. The compressor maintains a low pressure in the evaporator coil 17, and the refrigerant boils rapidly thereby absorbing heat from the evaporator coils as air passes in heat transfer relation with the evaporator coils as indicated by the arrow 36. The vaporized refrigerant is drawn through the suction line 34 back to the inlet port 35 of the compressor 12. In the compressor it is compressed to a high pressure and is subsequently discharged through the outlet port 37 into the condenser coil 15 where it is cooled by the flow of outside air as indicated by the arrow 38 and returns to a liquid. Thus the liquid refrigerant absorbs heat while changing from its liquid state to a vapor state in the evaporator and gives up heat in changing from a vapor to a liquid in the condenser.

A heat exchange circulation conduit 40 connects the water passage 22 of the heat exchanger 18 in series fluid circuit relation with the water storage tank 10. One end of the heat exchange circulation conduit 40 is coupled to the water storage tank 10 at a drain coupling 42 and the opposite end is connected to a coupling member 41 of the water passage 22. Water flows from the water storage tank 10 through the conduit and through the water passage 22 in counterflow relation with respect to the flow of refrigerant through the refrigerant passage 20. The opposite end of the water passage 22 is coupled to a return conduit 44 in which a pump 46 is connected in series fluid circuit relation for effecting the circulation of water from the water storage tank 10 through the water passage 22 of the heat exchanger 18. One end of the return conduit 44 is connected to the coupling member 43 of the water passage and the opposite end is coupled to the tank 10, preferably to the cold water inlet port 48 of the water storage tank 10. According to this arrangement, water in the storage tank 10 is thermally stratified with relatively cold water being withdrawn through the drain coupling 42 and is thereafter heated as it is circulated through the water passage 22 of the heat exchanger and then is discharged into the top of the water storage tank. The pump 46 is preferably water lubricated having a suitable fractional horsepower rating and a power requirement of 110 volts AC.

A hot water distribution conduit 50 is coupled to the hot water outlet port 52 of the water storage tank 10 for supplying hot water to a remote station (not shown) within the residence which may include a number of hot water faucets.

According to the invention, the high pressure refrigeration conduit 24 is precharged and connects the outlet port 37 of the compressor 12 in fluid communication with the inlet port 26 of the condenser 14. First and second bypass conduit sections 53, 54 are coupled by tee coupling members 53A, 54A to the refrigeration conduit 24 and are each terminated by quick connect/disconnect coupling members 55, 56, respectively. The bypass conduits 53, 54 in combination with the quick connect/disconnect coupling members 55, 56 provide convenient means for connecting the refrigerant passage 20 of the heat exchanger 18 to receive high pressure refrigerant from the compressor 12 for heat exchange purposes.

A shut-off valve 58 is connected in series fluid circuit relation in the high pressure refrigerant conduit 24 intermediate the upstream bypass conduit 53 and downstream bypass conduit 54. The shut-off valve 58 may be a manually operated diaphragm type valve, or it may be a solenoid operated gate valve suitable for refrigerant use. The refrigerant passage 20 of the heat exchanger 18 is also precharged and includes inlet and outlet conduit sections 20A, 20B connected in fluid communication with the upstream and downstream bypass conduit sections 53, 54, respectively. The inlet and outlet conduit sections of the refrigerant passage are connected to the bypass conduit sections by means of complementary quick connect/disconnect coupling members 59, 60 which engage the corresponding quick connect/disconnect coupling members 55, 56. The provision of the precharged refrigerant conduit 24 and the precharged refrigerant passage 20 of the heat exchanger in combination with the quick connect/disconnect coupling members and the shut-off valve 58 permits the heat exchanger 18 to be connected or disconnected from the refrigerant conduit 24 for initial installation, repair or replacement purposes without the loss of refrigerant and without introducing contaminants into the refrigeration system. With the provision of the precharged refrigerant conduit 24, the air conditioning or refrigerant system may be installed, tested and adjusted during the initial installation of the air conditioning or refrigeration system with the heat exchanger equipment being connected at a later time without disturbing the balanced refrigeration system. For initial operation of the air conditioning or refrigeration system, during preliminary testing, the shut-off valve 58 is placed in the open condition to allow the free circulation of refrigerant through the precharged refrigerant line 24. After the refrigerant passage of the heat exchanger 18 is connected to the bypass conduits of the precharged refrigerant conduit 24, the valve 58 is closed which causes the refrigerant to be diverted through the bypass conduit 53 through the refrigerant passage 20 for heat exchange purposes.

Figure 2:
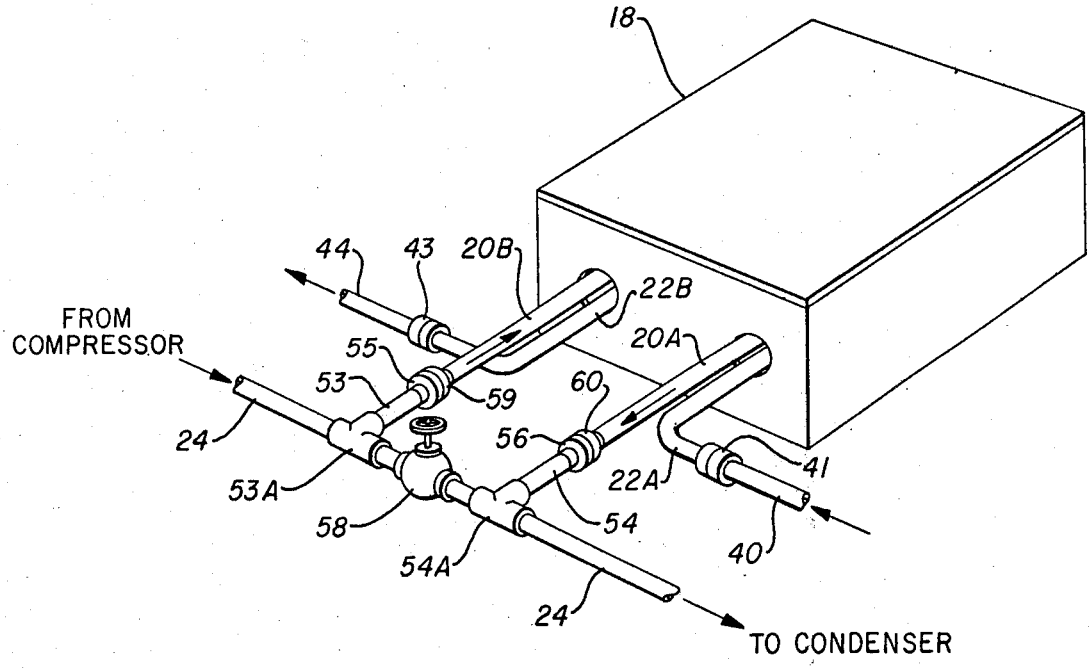

According to the foregoing arrangement, the heat exchanger 18 can be connected or disconnected from the refrigeration conduit without the loss of refrigerant and without introducing contaminants into the refrigeration conduit. Furthermore, the flow of refrigerant can be selectively diverted through the heat exchanger when the refrigerant passage 20 is connected to the refrigerant conduit 24 and when the shut-off valve 58 is closed. This arrangement permits the heat exchanger to be completely decoupled both thermally and mechanically from the refrigeration system when desired. This arrangement also facilitates installation of the heat recovery system in that the air conditioning or refrigeration system can be connected up, balanced and tested prior to connecting the heat exchange equipment which can be connected into the system at a later time as desired without requiring the refrigeration system to be purged and recharged. This arrangement also permits easy removal of the heat exchanger for repairs or replacement without interfering with the refrigerant system. The parallel connection of the shut-off valve 58 in combination with the refrigerant conduit 24 and the heat exchanger 18 is illustrated in greater detail in FIG. 2 of the drawing.

The heat exchanger 18 is preferably of the counterflow type for maximum heat transfer. The coaxial or tube-in-tube heat exchanger has proven very satisfactory. This type of heat exchanger consists of one or more assemblies of two tubes, one within the other, in which the hot gas refrigerant is conveyed through the outer tube with water flowing through the inner tube. These heat exchangers are sold commercially as water cooled refrigerant condensers by a number of refrigerant supply houses. Manufacturers and suppliers of the tube-in-tube condensers and model numbers commonly available are Edwards Engineering Corporation, model "S", Halstead Mitchell Company Series E.L., and Dunham Bush Series CICB.

Because of a very large amount of waste heat available which can be recovered from the air conditioning process, the heat exchanger 18 need only be sized with a BTU rating which will effectively remove the superheat from the high pressure refrigerant vapor with substantially all of the condensation taking place within the condenser 14. According to this arrangement, the high pressure refrigerant vapor discharged from the refrigerant passage 20 of the heat exchanger into the condenser is preferably substantially at its boiling point as it enters the condenser. The advantage of this arrangement is that since a more than adequate supply of heat energy is available for heating the water, it can be connected with an existing air conditioning or refrigeration system for removing only the super heat without disturbing the pressure balance within the system.

Because more heat may be recovered than can typically be utilized in the average residence or in some commercial applications, it is desirable to decouple the hot water circulation system from the heat exchanger when an adequate supply of hot water at a desired temperature is available in the water storage tank 10. This function is carried out by alternately energizing and deenergizing the pump 46 in response to the temperature of the water drawn from tank 10. Specifically, a temperature sensitive switch 72 is thermally coupled to sense the temperature of the water drawn from the drain connection 42 and is electrically coupled to the pump 46 and the power circuit 80 for energizing the pump 46 when the compressor 12 is energized and the water being drawn from the water storage tank 10 is less than a predetermined level, for example 160° F., and for de-energizing the pump 46 when the temperature of the water drawn from the drain connection of the tank is at or exceeds the predetermined level. To carry out this function, the temperature sensitive switch 72 is normally closed and opens only when the temperature it senses exceeds the predetermined level. An example of a suitable temperature sensitive switch is ThermODisc No. 27276 by ThermODisc Inc., which is a division of Emerson Electric Company.

With this arrangement, it will be seen that the temperature sensitive switch 72 will open to de-energize the pump 46 and thereby interrupt the flow of water through the heat exchanger when the temperature of the water circulating through the conduit 40 reaches a desired operating temperature thereby eliminating the possibility of exceeding the temperature and pressure limits of the hot water storage tank 10. Further decoupling can be obtained, if desired, by opening the shut-off valve 58 to provide a low resistance path for the flow of refrigerant through the conduit 24. Because the refrigerant passage 20 of the heat exchanger has a much larger fluid flow resistance as compared to the refrigerant conduit 24, very little refrigerant will flow through the refrigerant passage 20 when the shut-off valve 58 is in the open condition. To carry out this decoupling function, the shut-off valve 58 may be either a manually or solenoid operated valve.

It will be seen that the invention as described herein provides a waste heat recovery system in which the heat exchanger can be connected or disconnected to the refrigeration system and that the associated hot water storage system can be completely decoupled both mechanically and thermally with respect to the refrigeration system without risk of losing the refrigerant charge and without introducing contaminants into the system. This arrangement facilitates the installation of the heat recovery system in that the air conditioning or refrigeration system can be connected up, balanced and tested prior to connecting the heat exchange equipment which can be connected into the system at a later time as desired without requiring the refrigeration system to be purged and recharged. The arrangement also permits easy removal of the heat exchanger for repair or replacement without interfering with the refrigerant system.

Although a preferred embodiment of the invention has been described in detail, it should be understood that various changes, substitutions and alterations can be made therein without departing from the spirit and scope of the invention as defined by the appended claims.

What is claimed is:

1. A method of interconnecting a heat exchanger of a waste heat recovery system with a refrigeration system from which waste heat is to be recovered comprising the steps of:

providing a refrigeration system comprising a compressor, a condenser, and a conduit providing fluid communication between the outlet of said compressor and the inlet of said condenser, said conduit being precharged with a refrigerant, a heat exchanger comprising a refrigerant passage and a water passage mutually coupled in heat exchange relation, said refrigerant passage being precharged with refrigerant prior to initially interconnecting said heat exchanger with said refrigeration system, said refrigerant passage and said conduit including cooperating quick connect/disconnect couplings for interconnecting said heat exchanger with said refrigeration system;

initially operating said refrigeration system without said heat exchanger to enable refrigerant flow through said conduit;

removably connecting said refrigerant passage of said heat exchanger in parallel with said conduit and in fluid communication with the outlet of said compressor and the inlet of said condenser after an initial testing of said refrigeration system without said heat exchanger being mechanically coupled to said refrigeration system;

terminating the flow of refrigerant through said conduit for resultant diversion of said refrigerant flow through said refrigerant passage.

* * * * *